United States Patent [19]

Sodeno et al.

[11] Patent Number: 4,592,501

[45] Date of Patent: Jun. 3, 1986

[54] BUTTON ORIENTATION APPARATUS

[75] Inventors: Toshiaki Sodeno, Toyama; Yukio Taga, Uozu, both of Japan

[73] Assignee: Nippon Notion Kogyo Co., Ltd., Tokyo, Japan

[21] Appl. No.: 667,752

[22] Filed: Nov. 2, 1984

[30] Foreign Application Priority Data

Nov. 4, 1983 [JP] Japan ..... 58-171118[U]

[51] Int. Cl.[4] ..... A41H 37/10

[52] U.S. Cl. ..... 227/119

[58] Field of Search ..... 29/718; 227/119, 117, 227/118, 120, 155

[56] References Cited

U.S. PATENT DOCUMENTS 3,400,442 9/1968 Morris ..... 29/718
4,019,666 4/1977 Foults ..... 227/119
4,493,448 1/1985 Seki ..... 227/119

FOREIGN PATENT DOCUMENTS 59-11682 3/1984 Japan .

*Primary Examiner*—Paul A. Bell
*Attorney, Agent, or Firm*—Hill, Van Santen, Steadman & Simpson

[57] ABSTRACT

A button orientation apparatus comprising a setting die for receiving a button for attachment to a garment fabric, a clamping means for clamping the button on the die, a cam means for angularly moving the clamping means about its axis, and a control means operatively associated with and controlling rotation of the cam means so that the clamping means is oriented to position the button in the proper orientation with respect to the garment, the control means including a stopper pin engageable selectively with one of a plurality cam plates in the cam means.

7 Claims, 6 Drawing Figures

BUTTON ORIENTATION APPARATUS

BACKGROUND OF THE INVENTION

1. Field of the Invention:

This invention relates to improvements in and relating to an apparatus for setting buttons or the like in the proper orientations on garments.

2. Prior Art:

Machines for attaching buttons or snap fasteners to a garment are known in which for instance buttons and their mating tacks are delivered successively from their respective chutes to a coacting punch and die assembly and are attached in coupling relation to a garment held between the punch and the die. If the button bears on its exposed surface indicia such as designs, letters, trademarks, etc., it is desired that the button be oriented to the proper position with respect to a predetermined reference point or line on the garment, or stated otherwise, the manner in which the garment is worn.

U.S. Pat. No. 4,019,666, issued Apr. 26, 1977, discloses a button orienting apparatus which includes a pusher mechanism for moving a button along a slide bracket until a tab on the reverse side of the button is caught by a pair of jaws on a locking lever mounted on the slide bracket. The pusher mechanism further moves the button until the latter is placed in a cylindrical gripping head. Then, the gripping head with the button therein is turned through a predetermined angle. Such an angular movement of the gripping head is provided by a coacting rack and pinion. The pinion is connected to the gripping head by a coupling such as a universal joint, and the rack is reciprocatively driven by an air-pressurized cylinder. Since the gripping head functions as a setting die, the tendency is that the head becomes displaced axially and/or circumferentially due to impact by the punch. The coupling is provided to absorb and prevent such displacement of the gripping head from being transmitted to the pinion, but the coupling per se is susceptible to backlash which increases with torque and impact repeatedly imposed on the coupling, with the results that the gripping head fails to perform accurate angular orientation. Further, this frequent impact causes the coupling to be distorted at its bearings, making the gripping head inoperative. Moreover, the stroke of the rack is relatively large to turn the pinion through a predetermined angle, and hence the stroke of the cylinder must be accordingly large enough, which means a prolonged length of time for the orientation of buttons.

Japanese Patent Publication No. 59-11682 is directed to an improvement over the above prior art, and discloses a button orientation apparatus including a finger holder having a pair of fingers for gripping a button, the holder being vertically movably and rotatably mounted on a setting die. The finger holder is provided peripherally with a first gear engageable with a second gear which is adjustably driven by a cylinder mechanism. A cylindrical sleeve holder has a rotatable sleeve in which is journalled a rotative shaft. This shaft carries the above-mentioned gears on its upper end and a cam on its lower end. The sleeve has a means engageable with the cam for stopping the rotation of the shaft as the latter turns through predetermined angles. The orientation of a button is determined by the amount of rotation of the shaft which is in turn determined by manually positioning a pin on the sleeve holder selectively in one of the apertures in the sleeve. This operation is rather complicated and tedious.

SUMMARY OF THE INVENTION

According to the invention, there is provided a button orientation apparatus comprising a setting die for receiving a button thereon, a finger holder movably mounted on the die and having a pair of clamping fingers for clamping the button on the die, a cam assembly operatively connected via a drive means to the finger holder, and a control means operatively associated with and controlling the cam assembly so that the finger holder is oriented to position the button in the proper orientation with respect to a garment.

It is an object of the present invention to provide a button orientation apparatus which will overcome the foregoing difficulties of the prior art and which incorporates structural features to enable speedy and accurate setting of buttons on garments.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
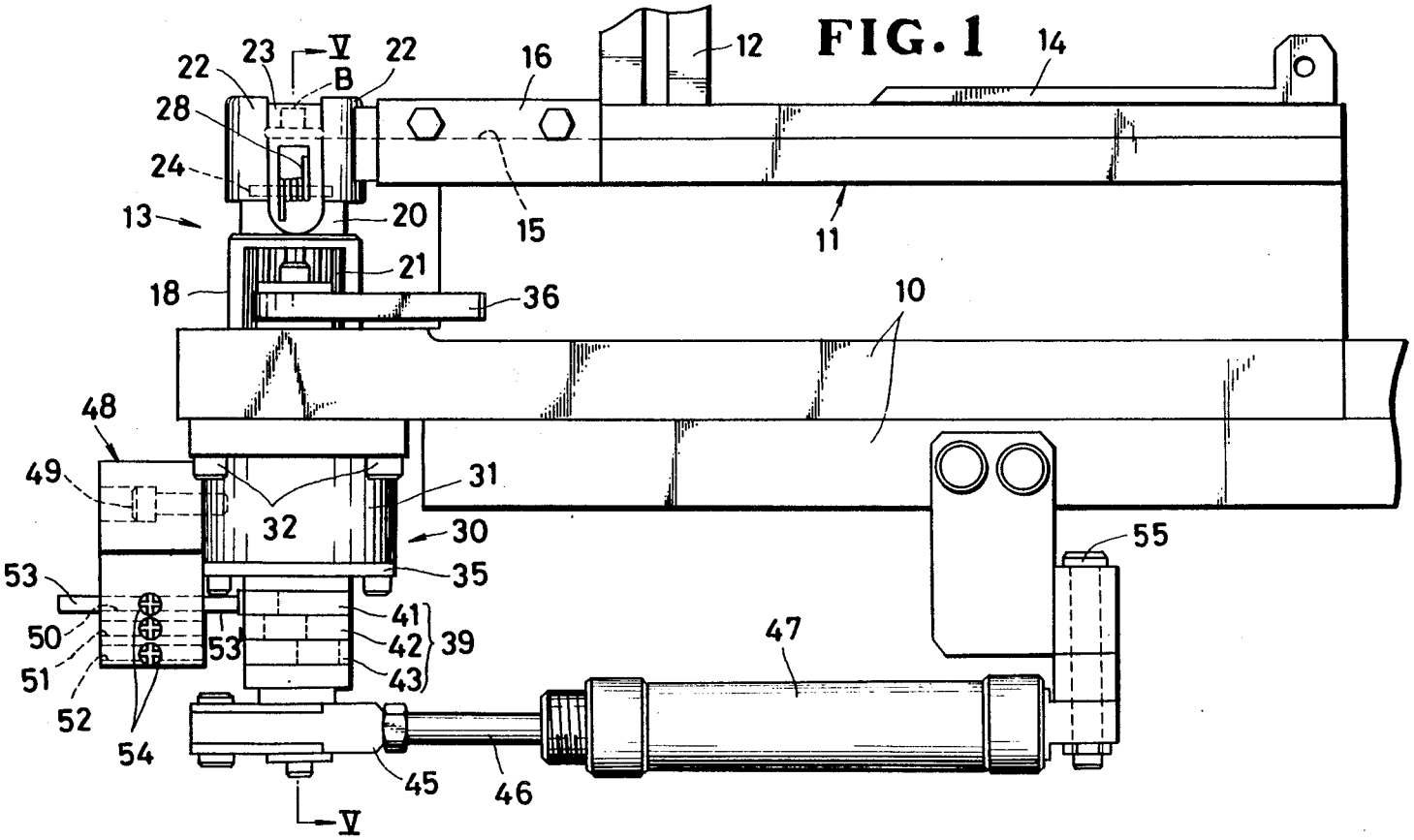
FIG. 1 is a fragmentary side elevational view of a button orientation apparatus according to the invention.
Figure 2:
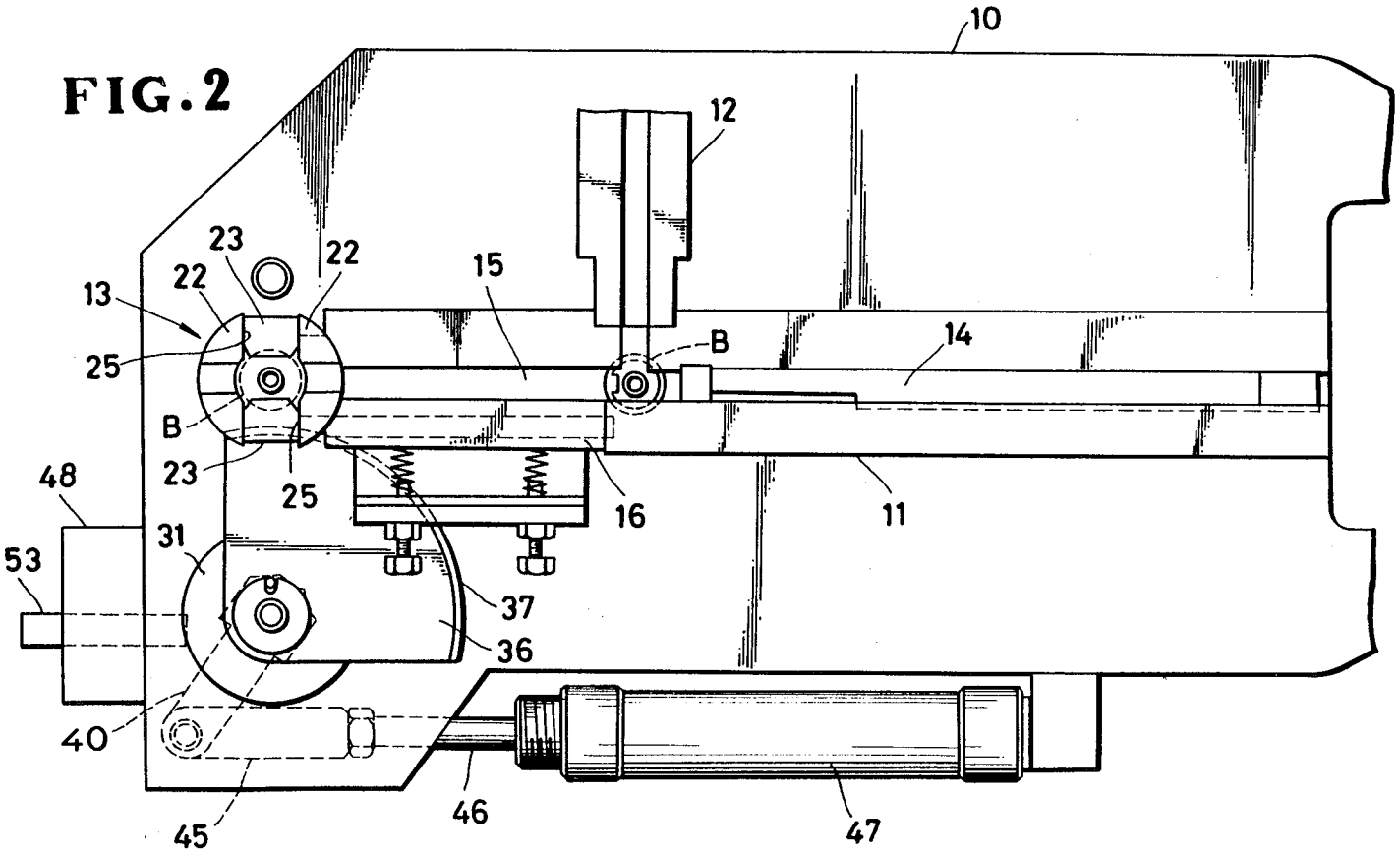
FIG. 2 is a fragmentary plan view of the apparatus of FIG. 1.
Figure 4:
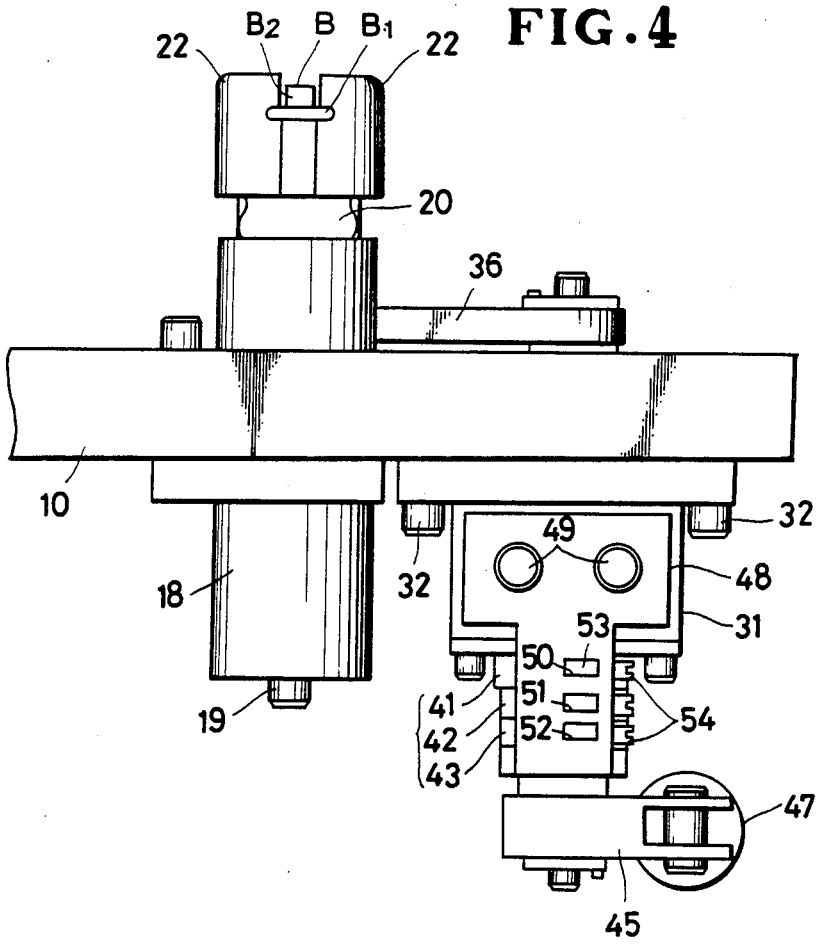
FIG. 4 is a fragmentary front view of the apparatus.

In FIGS. 1 and 2, there is shown a button orientation apparatus which generally comprises a support frame 10, an elongate horizontal guide 11 mounted thereon for guidedly transporting buttons B one at a time from a chute 12 to a die unit 13, and a pusher 14 slidably mounted in a guide channel 15 in the guide 11 for pushing the button out of the guide 11 into the die unit 13. The button B has a disk-like head $B_1$ bearing a desired indicia and a tab $B_2$ (FIG. 4).

Designated at 16 is a friction member provided in the guide 11 and engageable with the peripheral edge of the button head $B_1$ to keep the button B in rotation until the tab $B_2$ is captured by the pusher. The button B is thereafter guided linearly toward the die unit 13. Such button feeding mechanisms are well known and form no positive part of the invention. Hence, no further description details of this part of the apparatus will be required.

Figure 5:
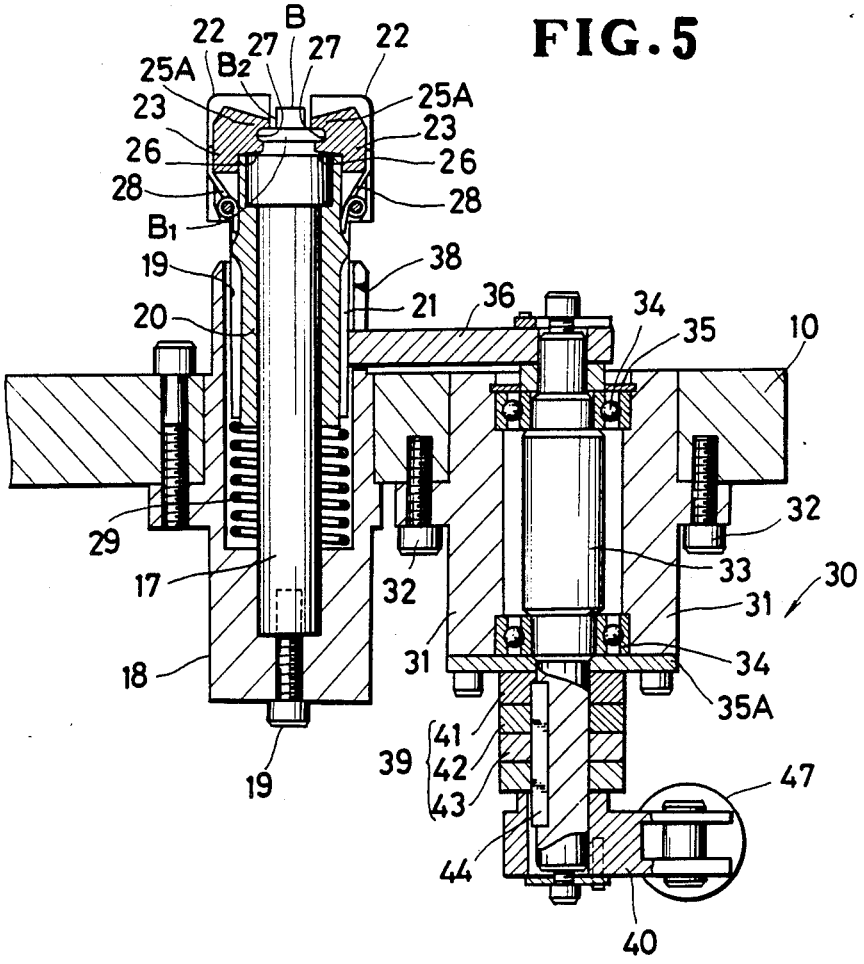
FIG. 5 is a cross-sectional view taken on the line V—V of FIG. 1.

As better shown in FIG. 5, the die unit 13 comprises a setting die 17 which coacts with a punch (not shown) to attach the button B to a garment (not shown) disposed between the die 17 and the punch as is well known in the art. The die 17 is secured at its lower end to a die holder 18 by means of a screw 19. The die holder 18, which is hollow at 19, is secured to the frame 10. A finger holder 20 is slidably and rotatably mounted on the die 17 and has on its lower periphery a ring gear 21. The finger holder 20 has at its upper end a flange 22 (FIG. 2) integral therewith. A pair of clamping fingers 23,23 (FIGS. 1, 2 and 5) are pivotally mounted on the flange 22 by means of a pair of pins 24,24, respectively, and are fitted in a pair of grooves 25,25 (FIG. 2) respectively formed in the flange 22. Each of the fingers 23 has on its upper end an inwardly directed projection 25A having an inclined bottom surface 26. An annular recess 27 extends horizontally in an inner surface of each finger projection 25. The fingers 23,23 are normally urged toward each other by means of a pair of springs 28,28, respectively. The finger holder 20 is normally urged upwardly by a compression spring 29.

The button B transported by the pusher 14 is set in position on the die 17 with its peripheral flange portion fitted snugly in the annular recesses 27,27 of the confronting fingers 23,23.

The die unit 13 is operatively connected with a drive unit 30. The drive unit 30 comprises a cylindrical shaft holder 31 secured to the frame 10 as at 32,32 and a rotary shaft 33 journalled in the holder 31 for rotation via bearings 34. Washers 35, 35A are provided to hold the shaft 33 against vertical displacement relative to the holder 31. The shaft 33 has connected to its upper end a sector gear 36 (FIG. 2) which has a toothed periphery 37 extending through an aperture 38 (FIG. 5) in the die holder 18 into meshing engagement with the ring gear 21 of the finger holder 20. The shaft 33 is connected at its lower end to a cam assembly 39 and a connecting arm 40 underlying the assembly 39.

Figure 3:
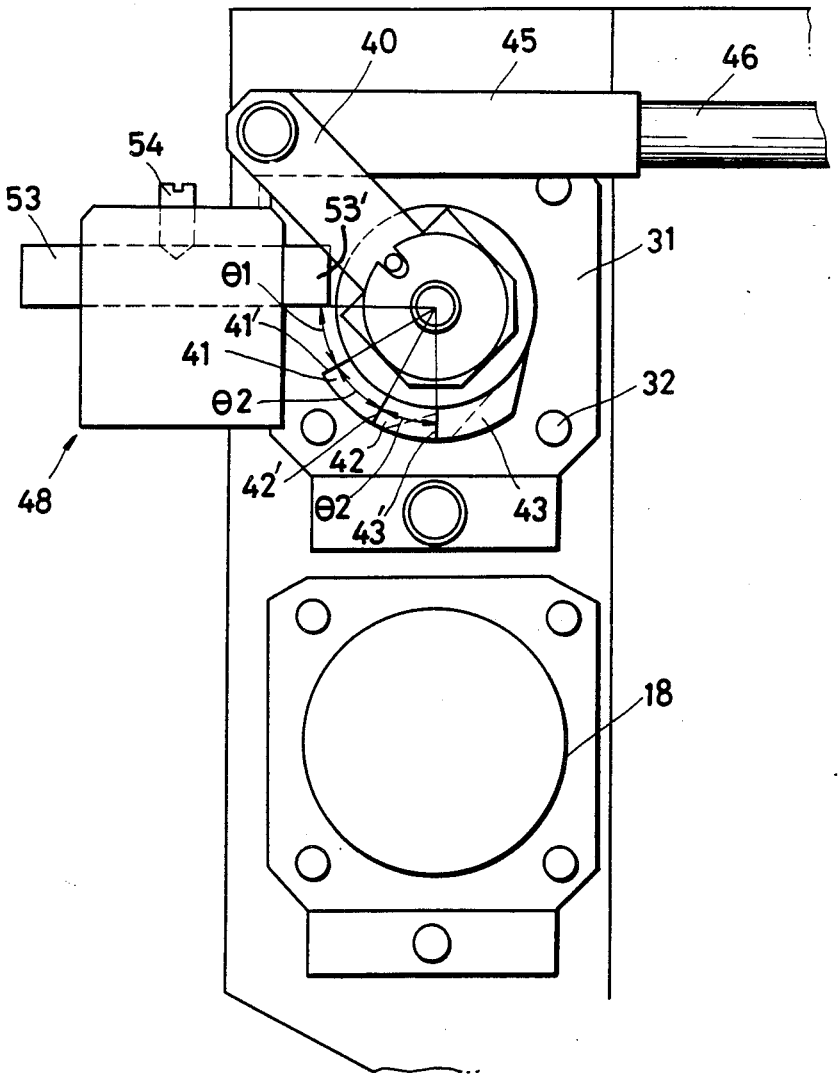
FIG. 3 is a fragmentary bottom view of the apparatus.

The cam assembly 39, which is rotative with the shaft 33, comprises a plurality of generally disc-shaped cam plates 41, 42 and 43 mounted in juxtaposed relation on and keyed to the rotary shaft 33 as at 44 in such relative positions that their respective engaging protuberances 41', 42' and 43' (FIG. 3) are displaced circumferentially a predetermined distance or stated otherwise held out of registry with respect to one another in the direction of rotation of the shaft 33 for purposes hereafter to be described.

The connecting arm 40 is connected via link 45 to a piston rod 46 of a pneumatically operated cylinder 47.

A pin holder 48 is secured at its upper portion to the shaft holder 31 by means of set screws 49 and has at its lower portion a plurality of apertures 50, 51 and 52 extending horizontally therethrough and registering in position with the cam plates 41, 42 and 43, respectively, as shown in FIG. 1. The apertures 50, 51 and 52 are adapted to receive a stopper pin 53, only the aperture 50 being illustrated as receiving the pin 53 to show one specific mode of operation. Designated at 54 is a set screw adapted to secure the pin 53 to the pin holder 48. In the illustrated embodiment, the pin 53 has its probe end 53' extending into the path of rotative movement of the protuberance 41' of the cam plate 41. By loosening the screw 54, however, the pin 53 may be retracted from the path of the cam plate 41, or the pin 53 may be transferred to the other aperture 51 or 52 depending upon the extent of orientation of the button B as later described.

The cylinder 47 is pivotally connected by a support pin 55 to the frame 10 as shown in FIG. 1, where its piston rod 46 is shown in forward stroke position in which the drive unit 30 is on standby. In this position, the apparatus may be operated where the button B need not be oriented.

Now, when handling buttons B that require orientation, the piston rod 46 is retracted from the position of FIG. 1 in response to retraction of the pusher 14 which has carried the button B onto the setting die 17. Retracting the piston rod 46 causes the shaft 33 to rotate counterclockwise as viewed in FIG. 2. This is accompanied by the rotation in the same direction of the sector gear 36 which is in meshing engagement with the gear 21 on the finger holder 20. The rotation of the shaft 33, hence the finger holder 20, terminates upon engagement of the stopper pin 53 with the protuberance 41' of the cam plate 41, whereupon the button B on the die 17 has been oriented in the proper position for setting onto a garment, not shown.

Actuating the cylinder 47 to make a forward stroke of the piston rod 46 back to the position of FIG. 1 or FIG. 2, causes the shaft 33 and hence the finger holder 17 to rotate clockwise back into the original position in which the clamping fingers 25A, 25A receive another button B for orientation in the manner described.

The angle of the rotation of the shaft 33 or the sector gear 36 may be varied at will by changing the operative position of the stopper pin 53 between the apertures 50, 51 and 52.

The angle of the rotation or orientation of the button B is determined by a selected gear ratio of the sector gear 36 to the ring gear 21 and also determinable by the angle $O_1$ between each of the cam protuberances 41', 42', 43' and the stopper pin 53. Therefore, the angle of displacement $O_2$ between cam protuberances 41', 42' and 43' may be selected such that the button B may be oriented desirably for angles of for instance 60 degrees, 120 degrees and 180 degrees, or 90 degrees, 180 degrees and 270 degrees, provided that the protuberances 41', 42' and 43' are equi-angularly spaced.

Figure 6:
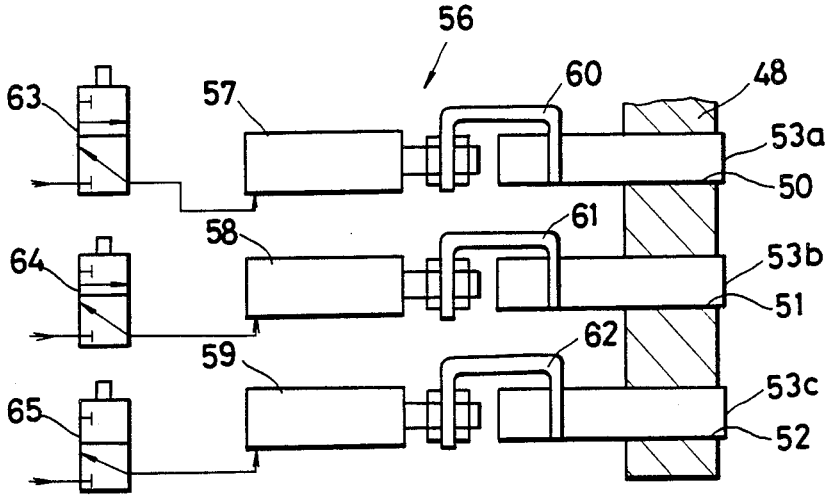
FIG. 6 is a diagrammatic view illustrating a cam control mechanism employed in accordance with the invention.

FIG. 6 diagrammatically illustrates a cam control mechanism 56 employed according to the invention for effecting automatic control of the operation of the cam assembly 39. The control mechanism 56 comprises a plurality of plungers or other suitable actuators 57, 58 and 59 assigned to the stopper pins 53*a*, 53*b* and 53*c*, respectively, a plurality of links 60, 61 and 62 connecting respective plungers and respective stopper pins, and a plurality of selector switches 63, 64 and 65 connected to the plungers 57, 58 and 59, respectively. The switches 63, 64 and 65 may be selectively operated to take any one of the stopper pins 53*a*, 53*b* and 53*c* into or out of engagement with the corresponding cam (41, 42 or 43).

Although various minor modifications may be suggested by those versed in the art, it should be understood that we wish to embody within the scope of the patent warranted hereon, all such embodiments as reasonably and properly come within the scope of our contribution to the art.

What is claimed is:

1. A button orientation apparatus which comprises:

(a) a support frame;

(b) a setting die secured to said support for receiving a button thereon;

(c) a finger holder rotatably and axially movably mounted on said setting die and having at its upper end a pair of clamping fingers for clamping the button on said setting die and having on its lower periphery a ring gear for rotating the finger holder;

(d) a shaft holder secured to said frame;

(e) a rotary shaft journaled in said shaft holder for rotation and having at its upper end a sector gear in meshing engagement with said ring gear;

(f) a cam assembly rotatively connected to the lower end of said shaft and having a plurality of cam plates in juxtaposed relation;

(g) a pin holder secured to said shaft holder and having a plurality of apertures registering in position respectively with said cam plates and a stopper pin releasably received in one of said apertures; and (h) a cylinder and piston drive for driving said rotary shaft.

2. An apparatus according to claim 1 wherein said cam plates have protuberances displaced a predetermined distance from one another and selectively engageable with one of said stopper pins.

3. An apparatus according to claim 2 wherein the distance between said cam protuberances is adjustable to vary the angle of orientation of the button.

4. An apparatus according to claim 1, including a cam control mechanism having a selector switch and an actuator connected thereto for taking said stopper pin selectively into and out of engagement with said cam plates.

5. An apparatus for orienting a button for attachment to a garment, comprising:

(a) a support frame;

(b) a guide mounted on said support frame and having a guide channel for guiding the button therethrough;

(c) a pusher slidably mounted in said guide for pushing the button through and out of said guide channel;

(d) a setting die secured to said support frame contiguous to one end of said guide for receiving thereon the button having been pushed out of said guide channel;

(e) a finger holder axially movably and rotatably mounted on said die and having at its upper end a pair of fingers for clamping the button on said die, said finger holder having on its periphery a ring gear;

(f) a shaft holder secured to said support frame;

(g) a rotary shaft rotatably mounted in said shaft holder and having at its upper end a sector gear meshing with said ring gear for rotating said finger holder in response to the rotation of said rotary shaft;

(h) a cylinder and piston drive operatively connected to said shaft for turning the latter through an angle;

(i) a cam assembly including a plurality of cam plates mounted in juxtaposed relation on a lower end of said shaft, said cam plates having respective engaging protuberances circumferentially displaced a predetermined angular distance from one another;

(j) a pin holder secured to said shaft holder and having a plurality of apertures registered in position respectively with said cam plates; and (k) a stopper pin releasably received in one of said apertures which is chosen depending on the extent to which the button is to be turned, said stopper pin thereby being selectively engageable with said engaging protuberance of one of said cam plates which is registered with said chosen aperture.

6. An apparatus according to claim 5, the angular distance between said cam protuberances being adjustable to vary the angle of orientation of the button.

7. An apparatus for orienting a button for attachment to a garment, comprising:

(a) a support frame;

(b) a guide mounted on said support frame and having a guide channel for guiding the button therethrough;

(c) a pusher slidably mounted in said guide for pushing the button through and out of said guide channel;

(d) a setting die secured to said support frame contiguous to one end of said guide for receiving thereon the button having been pushed out of said guide channel;

(e) a finger holder axially movably and rotatably mounted on said die and having at its upper end a pair of fingers for clamping the button on said die, said finger holder having on its periphery a ring gear;

(f) a shaft holder secured to said support frame;

(g) a rotary shaft rotatably mounted in said shaft holder and having at its upper end a sector gear meshing with said ring gear for rotating said finger holder in response to the rotation of said rotary shaft;

(h) a cylinder and piston drive operatively connected to said shaft for turning the latter through an angle;

(i) a cam assembly including a plurality of cam plates mounted in juxtaposed relation on a lower end of said shaft, said cam plates having respective engaging protuberances circumferentially displaced a predetermined angular distance from one another;

(j) a pin holder secured to said shaft holder and having a plurality of apertures registered in position respectively with said cam plates;

(k) a plurality of stopper pins slidably received one in each of said apertures; and (l) means for automatically controlling the movements of said stopper pins, said controlling means including (1) a plurality of actuators each connected to a respective one of said stopper pins and operable to bring the same into and out of engagement with said engaging protuberance of a corresponding one of said cam plates, and (2) a plurality of selector switches each operatively connected to a respective one of said actuators and selectively operable to render the same to take any one of said stopper pins into or out of engagement with the corresponding one of said cam plates, depending on the extent to which the button is to be turned.

* * * * *